United States Patent [19]

Denzer

[11] 4,266,585

[45] May 12, 1981

[54] VEHICLE MOUNTED LOG SPLITTER

[76] Inventor: Ronald W. Denzer, P.O. Box 845, Conrad, Mont. 59425

[21] Appl. No.: 97,702

[22] Filed: Nov. 27, 1979

[51] Int. Cl.[3] ..... B27L 7/00

[52] U.S. Cl. ..... 144/193 A; 144/193 R; 180/53 FE

[58] Field of Search ..... 144/193 R, 193 A; 180/53 C, 53 FE, 53 WA

[56] References Cited

U.S. PATENT DOCUMENTS

| | | | |
|---|---|---|---|
| 3,780,779 | 12/1973 | Guy | 144/193 A |
| 4,076,062 | 2/1978 | Kanik | 144/193 A |
| 4,103,724 | 8/1978 | Braid | 144/193 A |

*Primary Examiner*—W. Donald Bray
*Attorney, Agent, or Firm*—D. Paul Weaver

[57] ABSTRACT

A log splitter is securely attached to one bumper of an automotive vehicle and utilizes the power steering pump of the vehicle to operate a hydraulic cylinder of the log splitter which advances and retracts a log-engaging ram head in relation to a stationary log splitting wedge near the far end of the device. The splitting wedge has a protective swinging guard biased to the active safety guarding position by retraction of the cylinder operated ram head and biased to an inactive or open position by a spring device.

8 Claims, 5 Drawing Figures

FIG. 1
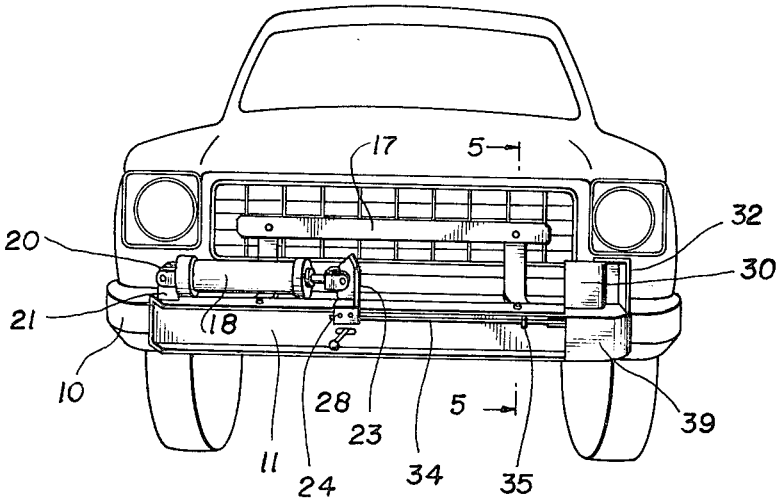
FIG. 4
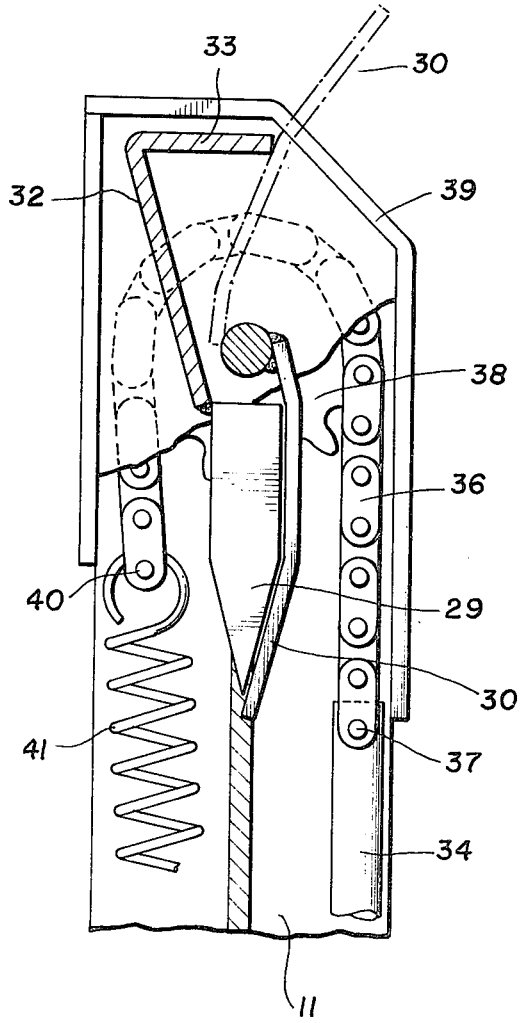
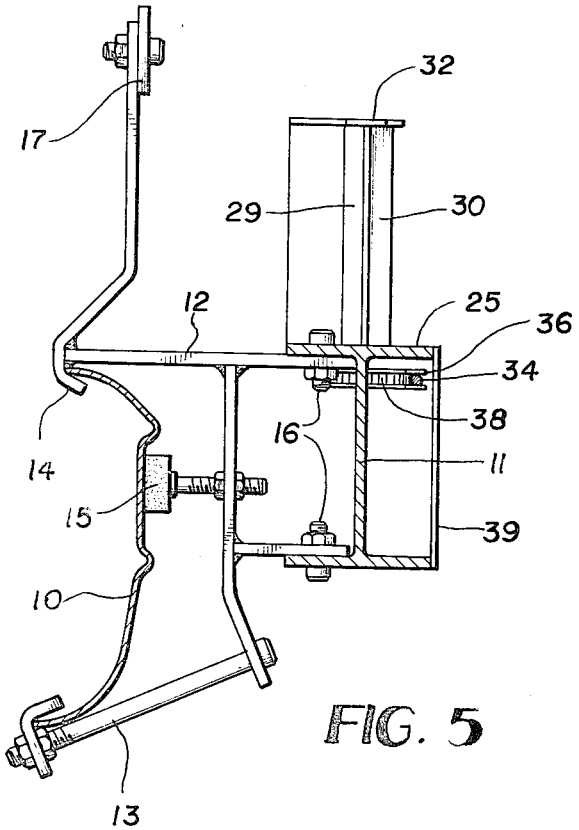
FIG. 5

VEHICLE MOUNTED LOG SPLITTER

BACKGROUND OF THE INVENTION

Various power-operated log splitting devices including vehicle mounted log splitters are known in the prior art. The following known prior art U.S. patents of general interest in relation to the present invention are made of record herein under the provisions of 37 CFR 1.56: Nos.

3,077,214
3,319,675
3,356,115
3,760,854
3,938,567
4,081,008
4,112,985.

The present invention seeks to improve on prior art vehicular leg splitters in terms of simplicity of construction, economy of manufacturing and efficiency and safety of operation. In accomplishing these objectives, a sturdy mount for the log splitter is firmly attached to the front bumper of a vehicle, such as a pick-up truck. The log splitter includes an extensible and retractable hydraulic cylinder on the mount receiving pressurized fluid from the power steering pump of the vehicle through a simple control valve on the back of the mount having an actuator accessible at the front of the mechanism. A log splitting wedge is fixed at the far end of the mount in opposition to a ram head advanced and retracted relative to the splitting wedge by the hydraulic cylinder. A safety guard for the sharpened edge of the wedge and to protect the operator swings horizontally on a vertical axis pivot between active and inactive positions under influence of a chain and sprocket drive connected to the ram head through an actuating rod and also connected to a biasing spring which urges the guard to the inactive position when the ram head is advanced by the cylinder to split the log. When the ram head retracts, the safety guard is positively driven to the active or safety position against spring tension and this is a safety feature, in that spring tension is not relied upon to activate the guard but only to de-activate it.

BRIEF DESCRIPTION OF THE DRAWINGS

FIG. 1 is a front elevation of a vehicle bumper attached power-operated log splitter according to the invention.

FIG. 4 is a fragmentary plan view, partly in section, showing the splitting wedge, swinging guard, and guard driving means.

FIG. 5 is an enlarged transverse vertical section taken on line 5—5 of FIG. 1.

DETAILED DESCRIPTION

Figure 2:
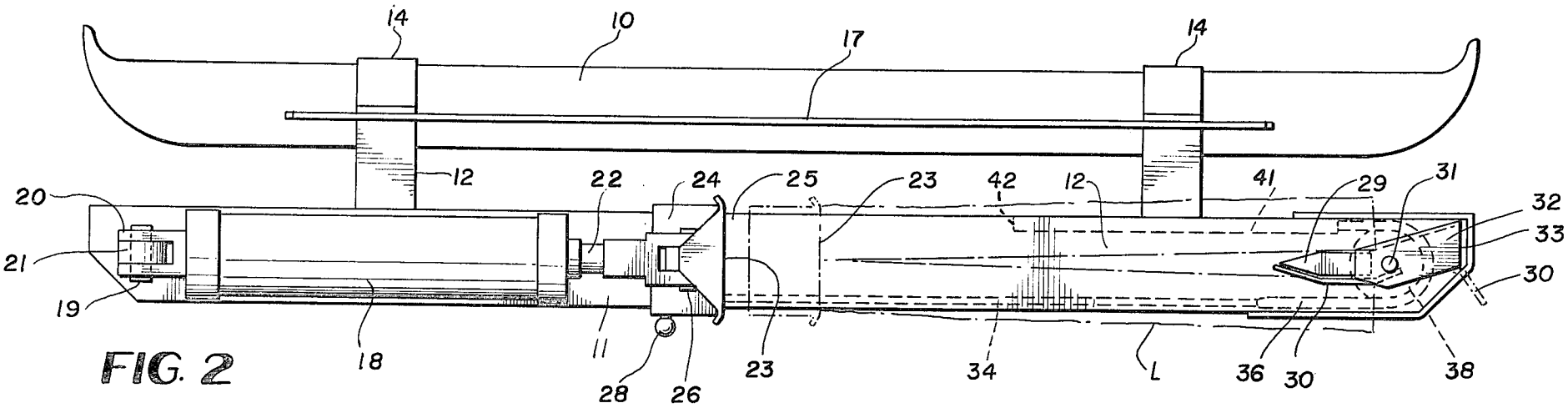
FIG. 2 is a plan view of the log splitter.

Referring to the drawings in detail wherein like numerals designate like parts, the numeral 10 designates the front bumper of a pick-up truck or other automotive vehicle, as shown in FIG. 1. The front bumper 10 serves as the support for the log splitting device or machine according to the invention. The device comprises a sturdy I-beam base 11 forwardly of the bumper 10 and parallel and substantially coextensive lengthwise with the bumper. The I-beam base 11 is clampingly attached to the bumper 10 by a pair of spaced mounting brackets

12 each having a lower clamping bolt 13 and an upper bumper clamping knuckle 14, as best shown in FIG. 5. Each mounting bracket 12 is provided with an adjustable rubber bearing pad 15 which engages the front of the bumper 10 and a pair of bolts 16 are used to attach the I-beam 11 to the mounting brackets 12. Preferably, a vehicle grill guard 17 rises from the brackets 12 and may be welded thereto to provide a unitary bracket structure. The grill guard may be omitted, if preferred.

The log splitter further comprises a horizontal axis power cylinder 18 immediately above one end of the I-beam base 11 and attached to the base by a pin element 19 extending through apertured lugs 20 and 21 on the cylinder and base 11, respectively. The rod 22 of the power cylinder 18 operates a ram head plate 23 disposed in a vertical plane and attached to a slide 24 which is guidingly engaged with the upper horizontal web 25 of the I-beam base 11. The rod 22 is coupled to the ram head plate 23 by a coupling pin 26.

The cylinder 18 is operated by the power steering pump of the motor vehicle, not shown, under control of a valve 27 suitably attached to the rear side of I-beam base 11, the valve having an actuator 28 projecting forwardly of the base 11 for easy accessibility. The valve per se and the fluid circuit between it and the power steering pump and the cylinder 10 are conventional and need not be shown or described in further detail for a proper understanding of the invention.

At the far end of the I-beam base 11, a log splitting wedge 29 is fixedly mounted with its vertical sharp edge in opposed relationship to the ram head plate 23. The wedge is suitably attached to the top surface of the base 11. A major feature of the invention lies in the provision of a safety guard plate 30 for the sharp edge of the wedge 29 and also for protection of the operator of the device or by-standers. The guard plate 30 is contoured to fit closely against the forward side of the wedge 29 when in the active guarding or safety position. The guard plate is attached by welding to a vertical axis pivot pin 31 rotatably held in a guard frame 32 fixed to the top of the I-beam base 11. The frame 32 includes a vertical stop flange 33 to limit horizontal swinging movement of the guard plate 30 to the position away from the wedge 29 shown in broken lines in FIG. 4. In such position, the guard plate 30 is entirely clear of the wedge 29 so that the latter can split a log L as it is forced endwise into the sharpened wedge by advancement of the ram head plate 23, FIG. 2.

Figure 3:
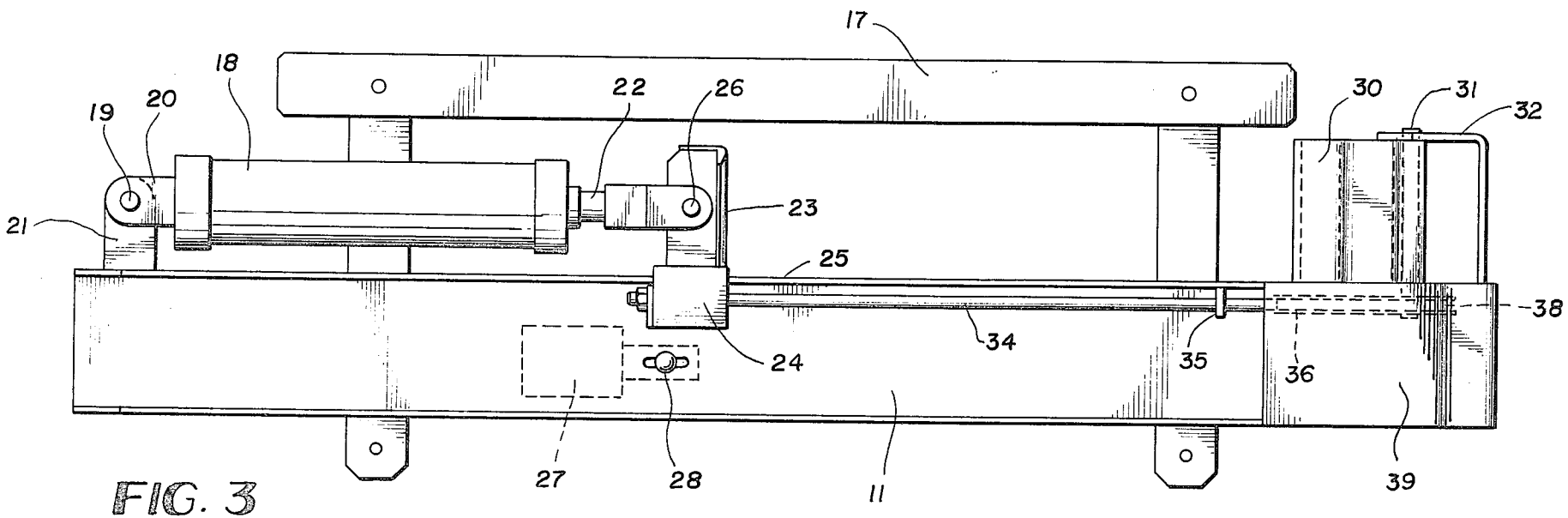
FIG. 3 is a front elevation of the device as shown in FIG. 2.

The guard plate 30 is operated in coordination with the ram head plate 23 by a connecting rod 34 attached to the slide 24 and extending forwardly therefrom parallel to the base 11 and under the top web 25. The base 11 has a slide bearing 35 for the rod 34 near the end of the base close to the wedge 29, FIG. 3. A length of sprocket chain 36 attached at 37, FIG. 4, to the rod 34 engages a sprocket gear 38 on the lower end of pin or shaft 31 and disposed within an enclosure 39 formed around the adjacent end of the I-beam base 11. Thus, the chain 36 and sprocket gear are substantially enclosed for safety at all times. The swinging guard 30 and the splitting wedge 29 are above the enclosure 39, as best shown in FIG. 3.

The other end of chain 36 near the interior side of the base 11 is attached at 40 to a retractile spring 41 having its other end anchored to the base 11 as at 42, FIG. 2.

When the rod 22 of cylinder 18 is extended under control of valve actuator 28 to split a log in the alreadydescribed manner, the force of spring 41 pulling on chain 36 automatically swings guard plate 30 to the open or inactive position against the stop flange 33, FIG.4, and out of the way of the splitting operation. After the operation, when the rod 22 and ram head plate 23 are retracted from the broken line position to the full line position shown in FIG. 2, the rod 34 is also retracted, and the guard plate 30 is positively swung to the active or safety position against the force of spring 41 which is now stretched to store energy for the next opening of the guard plate. For the sake of safety, the spring is not relied upon to place the guard plate in the active guarding position. The entire system is simple, positive-acting and reliable. Its advantages over the prior art should now be apparent.

It is to be understood that the form of the invention herewith shown and described is to be taken as a preferred example of the same, and that various changes in the shape, size and arrangement of parts may be resorted to, without departing from the spirit of the invention or the scope of the subjoined claims.

I claim:

1. A log splitter comprising a base member including mounting bracket means for attaching the base member to a support, a power cylinder attached to the base member and including a ram head plate having guided engagement along the base member, a log splitting wedge fixed on the base member in opposing relationship to the ram head plate, a guard for the log splitting wedge pivotally mounted on the base member for swinging movement toward and away from one side of the wedge, and driving means for the guard connected with the ram head plate.

2. A log splitter as defined in claim 1, and said driving means for the guard comprising a chain and sprocket drive for the guard on said base member, a connecting rod between the chain of said drive and said ram head plate, and a retractile spring connected between the other end of the chain and said base member and serving to swing the guard to an inactive position relative to said wedge when the ram head plate advances toward the wedge to split a log positioned on said base member between the wedge and ram head plate.

3. A log splitter as defined in claim 2, and a guard frame holding the pivot element of the guard above the base member and having a flange above the base member serving as a stop to arrest swinging of the guard in its inactive position.

4. A log splitter as defined in claim 1, and said mounting bracket means comprising a pair of clamp brackets near opposite ends of the base member for attaching the base member to the bumper of an automotive vehicle with the base member extending parallel to the bumper across the vehicle, said power cylinder comprising a hydraulic cylinder above the base member and extending lengthwise thereof, a cylinder control valve on the base member and adapted to be coupled between hydraulic fittings of the cylinder and a power steering pump of the vehicle on which the log splitter is mounted, and a manual operator for said valve.

5. A log splitter as defined in claim 3, and means forming an enclosure for the chain and sprocket drive at one end of said base member and below said guard frame.

6. A log splitter as defined in claim 1, and said log splitting wedge having an upright substantially sharp splitting edge facing the ram head plate and defining a beveled surface at least on one side of the wedge, and said guard comprising a plate shaped to conform to the profile of the side of the guard having said beveled surface.

7. A log splitter as defined in claim 6, and an upright axis pivot pin for the guard fixed to the guard and having pivot engagement with the top of the base member and with the top of a guard frame attached to the base member and extending above it.

8. A log splitter as defined in claim 1, and said driving means for the guard including spring means to move the guard to a non-active position and positive non-yielding means to move the guard to an active position relative to said wedge when the ram head plate is retracted from said wedge.

* * * * *